US005232632A

United States Patent [19]

Woo et al.

[11] Patent Number: 5,232,632

[45] Date of Patent: * Aug. 3, 1993

[54] FOAM LIQUID HARD SURFACE DETERGENT COMPOSITION

[75] Inventors: Ricky A. Woo, Hamilton; Daniel S. Cobb, Loveland; Jesus Velazquez; Janet L. O'Leary, both of Cincinnati, all of Ohio

[73] Assignee: The Procter & Gamble Company, Cincinnati, Ohio

[ * ] Notice: The portion of the term of this patent subsequent to Oct. 29, 2008 has been disclaimed.

[21] Appl. No.: 746,438

[22] Filed: Aug. 16, 1991

Related U.S. Application Data

[63] Continuation-in-part of Ser. No. 697,401, May 9, 1991, abandoned.

[51] Int. Cl.[5] ..... C11D 1/74; C11D 1/94; C11D 3/37; C11D 3/22

[52] U.S. Cl. ..... 252/546; 252/90; 252/174.23; 252/545; 252/153; 252/DIG. 10; 252/174.17; 252/174.18

[58] Field of Search ..... 252/90, 174.23, 545, 252/546, 153, DIG. 10, 174.17, 174.18

[56] References Cited

U.S. PATENT DOCUMENTS

| | | | |
|---|---|---|---|
| D. 244,991 | 7/1977 | Weckman et al. | D9/63 |
| D. 275,078 | 8/1984 | Wassergord et al. | D9/300 |
| D. 277,978 | 3/1985 | Bundschuh | D23/17 |
| 3,701,482 | 10/1972 | Sachnik | 239/590.3 |
| 3,836,076 | 9/1974 | Conrad et al. | 239/8 |
| 4,013,228 | 3/1977 | Schneider | 239/401 |
| 4,082,223 | 4/1978 | Nozawa | 239/333 |
| 4,161,288 | 7/1979 | McKinney | 239/333 |
| 4,219,159 | 8/1980 | Wesner | 239/343 |
| 4,414,128 | 11/1983 | Goffinet | 252/111 |
| 4,434,917 | 3/1984 | Saito et al. | 222/383 |
| 4,558,821 | 12/1985 | Tada et al. | 239/333 |
| 4,587,030 | 5/1986 | Casey | 252/90 X |
| 4,648,987 | 3/1987 | Smith et al. | 252/174.22 X |
| 4,730,775 | 3/1988 | Maas | 239/120 |
| 4,743,395 | 5/1988 | Leifheit | 252/106 |
| 4,759,867 | 7/1988 | Choy et al. | 252/143 |
| 4,779,803 | 10/1988 | Corsette | 239/428.5 |
| 4,788,006 | 11/1988 | Bolich, Jr. et al. | 252/550 |
| 4,804,491 | 2/1989 | Choy et al. | 252/94 |
| 4,819,835 | 4/1989 | Tasaki | 222/383 |
| 4,992,263 | 2/1991 | Tesmann et al. | 424/63 |
| 5,061,393 | 10/1991 | Linares et al. | 252/545 X |
| 5,102,573 | 4/1992 | Han et al. | 252/153 |

OTHER PUBLICATIONS

Kirk-Othmer, *Encyclopedia of Chemical Technology*, 3rd ed., 1980, John Wiley & Sons, Inc., vol. 12, pp. 62-64.

*Primary Examiner*—W. J. Shine
*Assistant Examiner*—Douglas J. McGinty
*Attorney, Agent, or Firm*—Robert B. Aylor

[57] ABSTRACT

Slightly thickened, shear-thinning, pseudoplastic liquid detergent compositions are packaged in a non-aerosol spray delivery package and preferably comprise a mixture of nonionic and zwitterionic detergent surfactants; hydrophobic cleaning solvent; and polycarboxylate detergent builder to provide superior cleaning of all of the soils commonly found in the bathroom. The compositions have a pH of from about 1 to about 13, preferably to about 5.5. The compositions are in the form of aqueous liquids.

22 Claims, No Drawings

FOAM LIQUID HARD SURFACE DETERGENT COMPOSITION

CROSS-REFEENCE TO RELATED APPLICATION

This is a continuation-in-part of our U.S. patent appln. Ser. No. 07/697,401, filed May 9, 1991, now abandoned, entitled "FOAM LIQUID HARD SURFACE DETERGENT COMPOSITIONS."

FIELD OF THE INVENTION

This invention pertains to non-aerosol liquid detergent compositions that are used (dispensed) as foams for cleaning hard surfaces and especially pertains to acidic liquid detergent compositions for bathrooms. Such compositions typically contain detergent surfactants, and, optionally, detergent builders and/or solvents to accomplish their cleaning tasks.

BACKGROUND OF THE INVENTION

The use of cleaning compositions containing organic water-soluble synthetic detergents, and, optionally, solvents, and/or detergent builders to produce foams for, e.g., bathroom cleaning tasks is known. However, there is a continuing need for improvement in such compositions, especially in the ease of application, the effectiveness of cleaning vertical surfaces, and the use of packaging that is more efficient. Typical "sprayer" packages that create a pattern of fine droplets of liquid provide good coverage with only minimal physical effort on the part of the consumer, but the consumer cannot always tell where the liquid spray has been applied. Furthermore, the liquid sprays quickly run down vertical surfaces. Foams have been used for cleaning hard surfaces, but typically require the use of aerosols or specific foaming devices to entrain a gas. Such devices typically involve economic and/or packaging disadvantages.

An object of the invention is to provide detergent compositions which are foamed by conventional liquid sprayers, especially trigger-type sprayers, with negligible effort and without appreciable loss of coverage. Preferred acidic compositions provide good cleaning for all of the usual hard surface cleaning tasks found in the bathroom including removal of hard-to-remove soap scum and hard water deposits. The use of a foam is especially effective for vertical surfaces and/or light colored surfaces, where it is more visible than a liquid.

SUMMARY OF THE INVENTION

This invention relates to an article of manufacture comprising slightly thickened, shear-thinning, pseudoplastic liquid detergent compositions having a viscosity, as disclosed hereinafter, in the range of from about 15 to about 250 cps, packaged in a non-aerosol spray device that produces a liquid spray when the viscosity of the composition is below about 15 cps, said compositions being capable of being dispensed as a visible foam when dispensed from said spray device "spray means," as described hereinafter. This invention also relates to said compositions, preferably those having a pH of from about 1 to about 13.

More specifically, the invention relates to an aqueous, acidic hard surface detergent composition comprising: (a) detergent surfactant, preferably a mixture of nonionic and zwitterionic detergent surfactants; (b) optional, but preferred, hydrophobic solvent that provides a primary cleaning function; (c) optional, but preferred, polycarboxylate detergent builder; and (d) polymeric, shear-thinning thickener to raise the viscosity of said composition to from about 15 to about 250 cps, said composition having a pH of from about 1 to about 5.5. These preferred compositions can also contain an optional buffering system to maintain the acidic pH and the balance typically being an aqueous solvent system and minor ingredients.

The compositions, including the preferred compositions, are typically formulated at usage concentrations and packaged in a container having "spray means" (means which would create a liquid spray when used with compositions having a lower viscosity), to make application to hard surfaces more convenient. The compositions can also be formulated as concentrates that can be diluted to usage concentrations in packages that contain said spray means.

DETAILED DESCRIPTION OF THE INVENTION

(a) The Detergent Surfactants

Detergent surfactants that are used in hard surface cleaner compositions include anionic, nonionic, amphoteric (including zwitterionic), and cationic detergent surfactants and mixtures thereof. Suitable detergents are well known in the art and include those described in U.S. Pat. Nos.: 4,111,854, Spadini et al., issued Sep. 5, 1978; 4,424,408, Imamura et al., issued Jan. 27, 1981; 4,414,128, Goffinet, issued Nov. 8, 1983: 4,612,135, Wenzel, issued Sep. 16, 1986; 4,743,395, Leifheit, issued May 10, 1988; 4,749,509, Kacher, issued Jun. 7, 1988; 4,759,867, Choy et al., issued Jul. 26, 1988; 4,769,172, Siklosi, issued Sep. 6, 1988; 4,804,491, Choy et al., issued Feb. 14, 1989; and 4,895,669, Choy et al., issued Jan. 23, 1990, all of said patents being incorporated herein by reference.

The preferred compositions described hereinbefore contain mixtures of nonionic and zwitterionic detergent surfactants which provide superior cleaning on all of the soils found in a bathroom, including oily/greasy soils and hard water soap scum. The combination of the two types of detergent surfactants provides good performance for all of the common types of soil encountered in the bathroom.

Amphoteric and Zwitterionic Detergent Surfactants

Amphoteric detergent surfactants are those that have either an anionic group, a cationic group, or both, depending upon the pH, and zwitterionic detergent surfactants contain both groups on the same molecule at a relatively wide range of pH's. The typical cationic group is an amine or quaternary ammonium group (for zwitterionic detergent surfactants), although other positively charged groups like sulfonium and phosphonium groups can also be used. The typical anionic hydrophilic groups are carboxylates and sulfonates, although other groups like sulfates, phosphates, etc., can be used. A generic formula for some preferred amphoteric (and zwitterionic) detergent surfactants is:

$$R—N(^{+})(R^{2})(R^{3})R^{4}X(^{-})$$

wherein R is a hydrophobic group; $R^2$ and $R^3$ are each hydrogen (not for zwitterionics) or, $C_{1-4}$ alkyl, hydroxyl alkyl or other substituted alkyl group which can also be joined to form ring structures with the N; $R^4$ is a moiety joining the cationic nitrogen atom to the hydrophilic group and is typically an alkylene, hydroxy alkylene, or polyalkoxy group containing from about one to about eight (preferably no more than about four) carbon atoms; and X is the hydrophilic group which is preferably a carboxylate or sulfonate group.

Preferred hydrophobic groups R are alkyl groups containing from about 8 to about 22, preferably less than about 18, more preferably less than about 16, carbon atoms. The hydrophobic group can contain unsaturation and/or substituents and/or linking groups such as aryl groups, amido groups, ester groups, etc.

A specific "simple" zwitterionic detergent surfactant is 3-(N-dodecyl-N,N-dimethyl)-2-hydroxy-propane-1-sulfonate, available from the Sherex Company under the trade name "Varion ® HC".

Other specific amphoteric detergent surfactants have the generic formula:

$$R—C(O)—N(R^2)—(CR^3{}_2)_n—N(R^2)_2(^+)—(CR^3{}_2)_n—SO_3(^-)$$

wherein each R is a hydrocarbon, e.g., said preferred hydrophobic groups, e.g., alkyl group containing from about 10 to about 18 carbon atoms, each ($R^2$) is either hydrogen or a short chain alkyl or substituted alkyl containing from one to about four carbon atoms, preferably groups selected from the group consisting of methyl, ethyl, propyl, hydroxy substituted ethyl or propyl and mixtures thereof, preferably methyl, each ($R^3$) is selected from the group consisting of hydrogen and hydroxy groups, and each n is a number from 1 to about 4, preferably from 2 to about 3; more preferably about 3, with no more than about one hydroxy group in any ($CR^3{}_2$) moiety. The R groups can be branched and/or unsaturated, and such structures can provide spotting/filming benefits, even when used as part of a mixture with straight chain alkyl R groups. The $R^2$ groups can also be connected to form ring structures. A zwitterionic detergent surfactant of this type is a $C_{10-14}$ fatty acylamidopropylene(hydroxypropylene)sulfobetaine that is available from the Sherex Company under the trade name "Varion ® CAS Sulfobetaine."

Compositions of this invention containing the above hydrocarbyl amido sulfobetaine (HASB) can contain more perfume and/or more hydrophobic perfumes than similar compositions containing conventional anionic detergent surfactants.

Other zwitterionic detergent surfactants useful herein include hydrocarbyl, e.g., fatty, amidoalkylenebetaines (hereinafter also referred to as "HAB"). These detergent surfactants have the generic formula:

$$R—C(O)—N(R^2)—(CR^3{}_2)_n—N(R^2)_2(^+)—(CR^3{}_2)_n—C(O)O(^-)$$

wherein each R is a hydrocarbon, e.g., an alkyl group containing from about 8 up to about 20, preferably up to about 18, more preferably up to about 16 carbon atoms, each ($R^2$) is either hydrogen or a short chain alkyl or substituted alkyl containing from one to about four carbon atoms, preferably groups selected from the group consisting of methyl, ethyl, propyl, hydroxy substituted ethyl or propyl and mixtures thereof, preferably methyl, each ($R^3$) is selected from the group consisting of hydrogen and hydroxy groups, and each n is a number from 1 to about 4, preferably from 2 to about 3; more preferably about 3, with no more than about one hydroxy group in any ($CR^3{}_2$) moiety. The R groups can be branched and/or unsaturated, and such structures can provide spotting/filming benefits, even when used as part of a mixture with straight chain alkyl R groups.

An example of such a detergent surfactant is a $C_{10-14}$ fatty acylamidopropylenebetaine available from the Miranol Company under the trade name "Mirataine ® BD".

The level of amphoteric, preferably zwitterionic, detergent surfactant in the composition is typically from about 0.01% to about 8%, preferably from about 1% to about 6%, more preferably from about 2% to about 4%. The level in the composition is dependent on the eventual level of dilution to make the wash solution. For cleaning, the composition, when used full strength, or the wash solution containing the composition, should contain from about 0.01% to about 8%, preferably from about 1% to about 6%, more preferably from about 2% to about 4%, of the amphoteric/zwitterionic detergent surfactant. Concentrated products will typically contain from about 0.02% to about 16%, preferably from about 4% to about 8% of the amphoteric/zwitterionic detergent surfactant.

Nonionic Detergent Surfactant

Compositions of this invention also contain nonionic detergent surfactant (also "cosurfactant" herein for the preferred mixtures of detergent surfactants in the preferred compositions) to provide cleaning and emulsifying benefits over a wide range of soils. Nonionic surfactants useful herein include any of the well-known nonionic detergent surfactants that have an HLB of from about 6 to about 18, preferably from about 8 to about 16, more preferably from about 10 to about 14. Typical of these are alkoxylated (especially ethoxylated) alcohols and alkyl phenols, and the like, which are well-known from the detergency art. In general, such nonionic detergent surfactants contain an alkyl group in the $C_{8-22}$, preferably $C_{10-18}$, more preferably $C_{10-16}$, range and generally contain from about 2.5 to about 12, preferably from about 4 to about 10, more preferably from about 5 to about 8, ethylene oxide groups, to give an HLB of from about 8 to about 16, preferably from about 10 to about 14. Ethoxylated alcohols are especially preferred in the compositions of the present type.

Specific examples of nonionic detergent surfactants useful herein include decyl polyethoxylate(2.5); coconut alkyl polyethoxylate(6.5); and decyl polyethoxylate(6).

A detailed listing of suitable nonionic surfactants, of the above types, for the detergent compositions herein can be found in U.S. Pat. No. 4,557,853, Collins, issued Dec. 10, 1985, incorporated by reference herein. Commercial sources of such surfactants can be found in McCutcheon's EMULSIFIERS AND DETERGENTS, North American Edition, 1984, McCutcheon Division, MC Publishing Company, also incorporated herein by reference.

The nonionic cosurfactant component in the preferred compositions herein, can comprise as little as 0.01% of said preferred compositions, but typically said preferred compositions will contain from about 0.5% to about 6%, more preferably from about 1% to about 4%, of nonionic cosurfactant. The ratio of nonionic cosurfactant to zwitterionic detergent surfactant in said preferred compositions should be from about 1:4 to about 3:1, preferably from about 1:3 to about 2:1, more preferably from about 1:2 to about 1:1.

Anionic Detergent Surfactant

Typical anionic detergent surfactants are the alkyl- and alkylethoxylate- (polyethoxylate) sulfates, paraffin sulfonates, olefin sulfonates, alpha-sulfonates of fatty acids and of fatty acid esters, and the like, which are well known from the detergency art. In general, such detergent surfactants contain an alkyl group in the $C_{9-22}$, preferably $C_{10-18}$, more preferably $C_{12-16}$, range. The anionic detergent surfactants can be used in the form of their sodium, potassium or alkanolammonium, e.g., triethanolammonium salts. $C_{12-18}$ paraffin-sulfonates and alkyl sulfates are especially preferred in the compositions of the present type.

A detailed listing of suitable anionic detergent surfactants, of the above types, for the detergent compositions herein can be found in U.S. Pat. No. 4,557,853, Collins, issued Dec. 10, 1985, incorporated by reference hereinbefore. Commercial sources of such surfactants can be found in McCutcheon's EMULSIFIERS AND DETERGENTS, North American Edition, 1984, McCutcheon Division, MC Publishing Company, also incorporated hereinbefore by reference.

In the preferred compositions described hereinbefore, said anionic detergent cosurfactant component is optional and can comprise as little as 0.001% of said preferred compositions herein when it is present, but typically said preferred compositions will contain from about 0.01% to about 5%, more preferably from about 0.02% to about 2%, of anionic detergent cosurfactant, when it is present. Anionic detergent surfactants are desirably not present, or are present only in limited amounts in said preferred compositions to promote rinsing of the surfaces.

Cationic Detergent Surfactants

Cationic detergent surfactants useful herein are typically quaternary ammonium detergent surfactants containing one long hydrophobic group (R) and three short chain groups ($R^2$, but not hydrogen) as disclosed hereinbefore for the zwitterionic detergent surfactant. The anion for the cationic detergent surfactant is typically a halide, preferably chloride, methyl sulfate, nitrate, or mixtures thereof.

The total detergent surfactant level is typically from about 0.1% to about 20%, preferably from about 0.5% to about 10%, more preferably from about 1% to about 5%, especially hard surface cleaning compositions.

(b) The Optional Hydrophobic Solvent

In order to obtain good cleaning, especially of lipid soils, The said preferred compositions and other compositions for use on hard surfaces, especially compositions that do not contain detergent builders, should contain hydrophobic solvent that has cleaning activity. The solvents employed in the hard surface cleaning compositions herein can be any of the well-known "degreasing" solvents commonly used in, for example, the dry cleaning industry, in the hard surface cleaner industry and the metalworking industry. The level of hydrophobic solvent is typically from about 1% to about 15%, preferably from about 2% to about 12%, most preferably from about 5% to about 10%.

Many of such solvents comprise hydrocarbon or halogenated hydrocarbon moieties of the alkyl or cycloalkyl type, and have a boiling point well above room temperature, i.e., above about 20° C.

The formulator of compositions of the present type will be guided in the selection of solvent partly by the need to provide good grease-cutting properties, and partly by aesthetic considerations. For example, kerosene hydrocarbons function quite well for grease cutting in the present compositions, but can be malodorous. Kerosene must be exceptionally clean before it can be used, even in commercial situations. For home use, where malodors would not be tolerated, the formulator would be more likely to select solvents which have a relatively pleasant odor, or odors which can be reasonably modified by perfuming.

The $C_6$–$C_9$ alkyl aromatic solvents, especially the $C_6$–$C_9$ alkyl benzenes, preferably octyl benzene, exhibit excellent grease removal properties and have a low, pleasant odor. Likewise, the olefin solvents having a boiling point of at least about 100° C., especially alpha-olefins, preferably 1-decene or 1-dodecene, are excellent grease removal solvents.

Generically, the glycol ethers useful herein have the formula $R^1O(R^2O)_mH$ wherein each $R^1$ is an alkyl group which contains from about 4 to about 8 carbon atoms, each $R^2$ is either ethylene or propylene, and m is a number from 1 to about 3, and the compound has a solubility in water of less than about 20%, preferably less than about 10%, and more preferably less than about 6%. The most preferred glycol ethers are selected from the group consisting of dipropyleneglycolmonobutyl ether, monopropyleneglycolmonobutyl ether, diethyleneglycolmonohexyl ether, monoethyleneglycolmonohexyl ether, and mixtures thereof.

The butoxy-propanol solvent should have no more than about 20%, preferably no more than about 10%, more preferably no more than about 7%, of the secondary isomer in which the butoxy group is attached to the secondary atom of the propanol for improved odor.

A preferred level of butoxy-propanol solvent for improved stability is from about 5% to about 7%.

A particularly preferred type of solvent for these hard surface cleaner compositions comprises diols having from 6 to about 16 carbon atoms in their molecular structure. Preferred diol solvents have a solubility in water of from about 0.1 to about 20 g/100 g of water at 20° C.

Some examples of suitable diol solvents and their solubilities in water are shown in Table 1.

TABLE 1

Solubility of Selected Diols in 20° C. Water

| Diol | Solubility (g/100 g $H_2O$ |
|---|---|
| 1,4-Cyclohexanedimethanol | 20.0* |
| 2,5-Dimethyl-2,5-hexanediol | 14.3 |
| 2-Phenyl-1,2-propanediol | 12.0* |
| Phenyl-1,2-ethanediol | 12.0* |
| 2-Ethyl-1,3-hexanediol | 4.2 |
| 2,2,4-Trimethyl-1,3-pentanediol | 1.9 |
| 1,2-Octanediol | 1.0* |

*Determined via laboratory measurements.
All other values are from published literature.

The diol solvents are especially preferred because, in addition to good grease cutting ability, they impart to the compositions an enhanced ability to remove calcium soap soils from surfaces such as bathtub and shower stall walls. These soils are particularly difficult to remove, especially for compositions which do not contain an abrasive. The diols containing 8–12 carbon atoms are preferred. The most preferred diol solvent is 2,2,4-trimethyl-1,3-pentanediol.

Other solvents such as benzyl alcohol, n-hexanol, and phthalic acid esters of $C_{1-4}$ alcohols can also be used.

Terpene solvents and pine oil, are usable, but are preferably not present.

(c) The Optional Polycarboxylate Detergent Builder

Polycarboxylate detergent builders useful herein, especially in the said preferred compositions, include the builders disclosed in U.S. Pat. No. 4,915,854, Mao et al., issued Apr. 10, 1990, said patent being incorporated herein by reference. Suitable detergent builders preferably have relatively strong binding constants for calcium under acid conditions. Preferred detergent builders include citric acid, and, especially, builders having the generic formula:

$$R^5-[O-CH(COOH)CH(COOH)]_nR^5$$

wherein each $R^5$ is selected from the group consisting of H and OH and n is a number from about 2 to about 3 on the average. Citric acid at a level of from about 3% to about 6% is preferred for stability reasons. Other preferred detergent builders include those described in the copending U.S. patent application Ser. No. 285,337 of Stephen Culshaw and Eddy Vos for "Hard-Surface Cleaning Compositions," filed Dec. 14, 1988, said patent application being incorporated herein by reference.

In addition to the above detergent builders, other detergent builders that are relatively efficient for hard surface cleaners and/or, preferably, have relatively reduced filming/streaking characteristics include the acid forms of those disclosed in U.S. Pat. No. 4,769,172, Siklosi, issued Sep. 6, 1988, and incorporated herein by reference. Still others include the chelating agents having the formula:

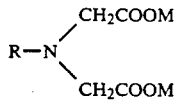

wherein R is selected from the group consisting of:

$-CH_2CH_2CH_2OH$; $-CH_2CH(OH)CH_3$;

$-CH_2CH(OH)CH_2OH$; $-CH(CH_2OH)_2$; $-CH_3$;

$-CH_2CH_2OCH_3$; $-\underset{\underset{O}{\|}}{C}-CH_3$; $-CH_2-\underset{\underset{O}{\|}}{C}-NH_2$;

$-CH_2CH_2CH_2OCH_3$; $-C(CH_2OH)_3$;

and mixtures thereof;

and each M is hydrogen.

Chemical names of the acid form of the chelating agents herein include:

N(3-hydroxypropyl)imino-N,N-diacetic acid (3-HPIDA);

N(-2-hydroxypropyl)imino-N,N-diacetic acid (2-HPIDA);

N-glycerylimino-N,N-diacetic acid (GLIDA);

dihydroxyisopropylimino-(N,N)-diacetic acid (DHPIDA);

methylimino-(N,N)-diacetic acid (MIDA);

2-methoxyethylimino-(N,N)-diacetic acid (MEIDA);

amidoiminodiacetic acid (also known as sodium amidonitrilotriacetic, SAND);

acetamidoiminodiacetic acid (AIDA);

3-methoxypropylimino-N,N-diacetic acid (MEPIDA); and tris(hydroxymethyl)methylimino-N,N-diacetic acid (TRIDA).

Methods of preparation of the iminodiacetic derivatives herein are disclosed in the following publications:

Japanese Laid Open publication 59-70652, for 3-HPIDA;

DE-OS-25 42 708, for 2-HPIDA and DHPIDA;

Chem. ZVESTI 34(1) p. 93-103 (1980), Mayer, Riecanska et al., publication of Mar. 26, 1979, for GLIDA;

C.A. 104(6)45062 d for MIDA; and

Biochemistry 5, p. 467 (1966) for AIDA.

The chelating agents of the invention are preferably present at levels of from about 2% to about 14% of the total composition, more preferably from about 3% to about 12%, even more preferably from about 5% to about 10%.

(d) The Polymeric Shear-Thinning Thickener

Compositions which are inherently shear-thinning and pseudoplastic can be used without modification. However, most hard surface cleaning compositions contain relatively low (less than about 10%) detergent surfactant and have viscosities of less than about 15 cps. Accordingly, a thickener is usually required.

The polymeric shear-thinning thickener can be any of the shear-thinning thickeners known in the art to thicken liquid compositions and especially aqueous compositions. Substituted cellulose materials, e.g., carboxymethylcellulose, hydroxymethylcellulose, etc., and naturally occurring thickeners like carrageenan and xanthan gum are useful herein. Xanthan gum is the preferred thickener. Xanthan gum is disclosed in U.S. Pat. No. 4,788,006, Bolich, issued Nov. 29, 1986, at Col. 5, line 55 through Col. 6, line 2, said patent being incorporated herein by reference.

Hard surface detergent compositions and especially the preferred detergent compositions described hereinbefore can be thickened by a process in which the thickener is added, preferably in fully hydrated form, at a level of from about 0.01% to about 1%, or even 1.5% preferably from about 0.05% to about 0.5%, (or 0.2%) more preferably from about 0.08% to about 0.3%, to raise the viscosity of a composition whose viscosity is less than about 15 cps to from about 15 to about 250, preferably to above about 30 cps, e.g., from about 30 to about 100 cps. If the viscosity is too low, the foam is not visible and at even the slightly higher viscosities, the area covered by the foam spray pattern starts to decrease substantially.

The viscosity is determined using a Brookfield Synchroelectric Viscometer, model LVT, made by Brookfield Engineering Laboratory, Inc., Stoughton, Mass., using a No. 1 spindle at 60 rpm, and at a temperature of about 20° C. (Constant shear rate of about 13 inversed seconds.)

Shear-thinning characteristics of, e.g., polymers and/or compositions, are determined using a Carrimed Controlled Stress Rheometer Model CSL 100, made by Carrimed Ltd., Interpret House, Curtis Road Estate, Dorking, Surry RH 4 IDP, England. The Rheometer employs double concentric cylinders geometry to make steady shear measurements at various shear rates. These measurements are made at about 26 C. The shear-thinning, pseudoplastic behavior of the xanthan gum system can be mathematically modeled by the equation:

$$N = KR^{n-1}$$

where N is the apparent viscosity, K is the consistency constant, R is the shear rate, and n is the shear index. For best spraying results (dispensing) the values of K and n should give viscosities below 15 cps at spraying shear rates (~10,000 inversed seconds, as reported in trade literature).

Shear-thinning behavior is described in U.S. Pat. No. 4,783,283, Stoddart, issued Nov. 8, 1988, especially the portion appearing at column 2, line 46, et seq.

(e) The Aqueous Solvent System

The balance of the formula is typically water. Nonaqueous polar solvents with only minimal cleaning action like methanol, ethanol, isopropanol, ethylene glycol, propylene glycol, and mixtures thereof are usually not present. When the nonaqueous polar solvent is present, the level of nonaqueous polar solvent is from about 0.5% to about 10%, preferably less than about 5%, and the level of water is from about 50% to about 97%, preferably from about 75% to about 95%.

(f) The Optional Ingredients

The compositions herein can also contain other various adjuncts which are known to the art for detergent compositions so long as they are not used at levels that cause unacceptable spotting/filming.

Buffering materials are especially desirable optional ingredients. Although the acidic detergent builders herein will normally provide the desired acid pH, the composition can also contain additional buffering materials to give a pH in use of from about 1 to about 13, preferably from about 1 to about 5.5, more preferably from about 2 to about 4.5, and even more preferably from about 3 to about 4.5. pH is usually measured on the product. The buffer is selected from the group consisting of: mineral acids such as HCl, $HNO_3$, etc., and organic acids such as acetic, succinic, tartaric, etc., and mixtures thereof. The buffering material in the system is important for spotting/filming. Preferably, the compositions are substantially, or completely free of materials like oxalic acid that are typically used to provide cleaning, but which are not desirable from a safety standpoint in compositions that are to be used in the home, especially when very young children are present.

Nonlimiting examples of other such adjuncts are:

Enzymes such as proteases;

Hydrotropes such as sodium toluene sulfonate, sodium cumene sulfonate and potassium xylene sulfonate; and Aesthetic-enhancing ingredients such as colorants and perfumes, providing they do not adversely impact on spotting/filming in the cleaning of glass. The perfumes are preferably those that are more water-soluble and/or volatile to minimize spotting and filming.

Perfumes

Most hard surface cleaner products contain some perfume to provide an olfactory aesthetic benefit and to cover any "chemical" odor that the product may have.

The perfume ingredients and compositions of this invention are the conventional ones known in the art. Selection of any perfume component, or amount of perfume, is based solely on aesthetic considerations. Suitable perfume compounds and compositions can be found in the art including U.S. Pat. Nos.: 4,145,184, Brain and Cummins, issued Mar. 20, 1979; 4,209,417, Whyte, issued Jun. 24, 1980; 4,515,705, Moeddel, issued May 7, 1985: and 4,152,272, Young, issued May 1, 1979, all of said patents being incorporated herein by reference.

Perfume ingredients useful herein, along with their odor character, and their physical and chemical properties, such as boiling point and molecular weight, are given in "Perfume and Flavor Chemicals (Aroma Chemicals)," Steffen Arctander, published by the author, 1969, incorporated herein by reference.

Selection of any particular perfume ingredient is primarily dictated by aesthetic considerations, but more water-soluble materials are preferred, as stated hereinbefore, since such materials are less likely to adversely affect the good spotting/filming properties of the compositions.

Sodium cumene sulfonate at a level of from about 3% to about 4% is preferred as a hydrotrope for optimum stability.

(g) The Spray Means

The compositions herein are used by placing them in a package comprising a non-aerosol spray device "spray means." Said spray means is any of the manually activated, preferably "trigger-type," means for producing a spray of liquid droplets as is known in the art. Typical spray means are disclosed in U.S. Pat. Nos.: 4,082,223, Nozawa, issued Apr. 4, 1978; 4,161,288, McKinney, issued Jul. 17, 1979: 4,558,821, Tada et al., issued Dec. 17, 1985: 4,434,917, Saito et al., issued Mar. 6, 1984; and 4,819,835, Tasaki, issued Apr. 11, 1989, all of said patents being incorporated herein by reference. The spray bottle, or container can be any of the ones commonly used for containing hard surface cleaner detergent compositions. Examples of bottles are those in U.S. Design Pat. Nos.: 244,991, Weekman et al., issued Jul. 12, 1977; and 275,078, Wassergord et al., issued Aug. 14, 1984, said patents being incorporated herein by reference.

The spray means herein do not include those that incorporate a propellant gas into the liquid and also do not include those that will foam even detergent compositions having a viscosity of less than about 15 cps. However, if a device can be adjusted to either give a liquid spray or a foam, said device is included herein only when it is adjusted to give a liquid spray. The spray means herein are typically those that act upon a discrete amount of the composition itself, typically by means of a piston that displaces the composition and expels the composition through a nozzle to create a spray of thin liquid. Surprisingly, it has been found that a slightly thickened, shear-thinning, pseudoplastic aqueous hard surface detergent composition, when expelled through such a means, will form a pattern of foam (inclusing mixtures of foam and liquid) that has an area that is similar to, or only slightly smaller than, the liquid spray, and with a clearly visible content of foam. Preferably the volume of foam (and any liquid) that is dispensed is more than about twice, more preferably more than about three times, the volume of the product dispensed. The foam acts to define the area covered by the spray and, on vertical surfaces acts to delay the descent of the composition (increased cling time). The additional cling time provides improved cleaning and/or ease of cleaning.

One specific composition herein is a slightly thickened, stable, shear-thinning, pseudoplastic liquid detergent composition consisting essentially of: from about 1% to about 3% of 3-(N-dodecyl-N,N-dimethyl-2-hydroxypropane-1-sulfonate; from about 1% to about 3% decyl polyethoxylate (6); from about 5% to about 7% butoxy propoxy propanol; from about 3% to about 6% citric acid; from about 0.1% to about 0.15% xanthan gum; from about 3% to about 4% sodium cumene sulfonate; and the balance being water, buffering agents, and minor ingredients.

In a preferred process for using the products described herein, and especially those formulated to be used at full strength, the product is sprayed onto the surface to be cleaned and then wiped off with a suitable material like cloth, sponge, a paper towel, etc. Surprisingly, the compositions and processes described herein provide effective disinfectancy.

All parts, percentages, and ratios herein are "by weight" unless otherwise stated. All number values are approximate unless otherwise stated.

The invention is illustrated by the following Examples.

EXAMPLE I

| Ingredient | Weight % |
|---|---|
| 3-(N-dodecyl-N,N-dimethyl)-2-hydroxy-propane-1-sulfonate (DDHPS) | 2.0 |
| Decyl polyethoxylate(6.0) (DPE6) | 2.0 |
| Butoxy Propoxy Propanol (BPP) | 8.0 |
| Citric Acid | 6.0 |
| Xanthan Gum* | as indicated |
| Sodium Cumene Sulfonate (SCS) | 3.0 |
| Water, Buffering Agents, and Minors pH = 3.0 | up to 100 |

*The xanthan gum is Keltrol ®, sold by Kelco, a Division of Merck & Co., Inc.

The above generic formula is prepared as three separate specific formulas A, B, and C with different levels of xanthan gum.

Formula A contains no xanthan gum, Formula B contains about 0.12% xanthan gum, and Formula C contains about 0.18% xanthan gum. Formula A has a viscosity of about 5 cps and Formulas B and C are shear-thinning, pseudoplastic compositions having viscosities of about 50 and 90 cps, respectively. When the compositions are sprayed through the trigger-type sprayer used by the commercial product CINCH ®, the maximum force in pounds required for dispensing A, B, and C, are all essentially the same and about 7 pounds force.

When the formulas are sprayed through the same CINCH trigger-type sprayer, the areas of the resulting generally circular spray patterns are roughly equivalent.

The "cling" time for A is about 2.8 seconds, and the cling times for B and C are about >30 seconds and >30 seconds, respectively. This difference in cling time is substantial and gives compositions B and C more time to soften soil deposits which in turn results in B and C providing easier and/or more complete removal of typical bathroom soils. The patterns for B and C are also much more visible on light colored tiles than the pattern for A. Formula A is dispensed as a liquid and Formulas B and C are dispensed, at least partially and visibly, as foams. Formulas B and C gave foams of about 5, or more, times the volume of the liquid dispensed.

Trigger-type spray devices used for commercial products such as CINCH ®, TILEX ®, and LYSOL ® are used to dispense the above Formula B and the results in all cases are foams of about the same characteristics.

Formula B, having a viscosity of 53 cps, has shear-thinning pseudoplastic behavior expressed, using the formula given hereinbefore, by: $N=166.1\ R^{-0.44}$. At a spraying shear rate of 10,000 inversed seconds, the theoretical viscosity is about 3 cps, which provides good spray properties. The composition almost immediately reverts to the higher viscosity after spraying to provide good cling time.

| Ingredient | Weight % |
|---|---|
| DDHPS | 2.0 |
| DPE6 | 2.0 |
| BPP | 8.0 |
| Oxydisuccinic Acid (ODS) | 6.0 |
| Xanthan Gum | 0.18 |
| SCS | 1.6 |
| Water, Buffering Agents, and Minors pH = 3.0 | up to 100 |

EXAMPLE III

A liquid hard surface cleaner composition is prepared according to the following formula:

| Ingredient | Weight % |
|---|---|
| DDHPS | 2.0 |
| ODS | 10.0 |
| DPE6 | 2.0 |
| BPP | 6.0 |
| Xanthan Gum | 0.1 |
| SCS | 7.5 |
| Water, Buffering Agents, and Minors pH = 4.5 | up to 100 |

EXAMPLE IV

| Ingredient | Weight % |
|---|---|
| 3-(N-cetyl-N,N-dimethyl)-propane-1-sulfonate | 2.0 |
| Decyl polyethoxylate(2.5) | 1.1 |
| DPE6 | 2.9 |
| ODS | 10.0 |
| Hydroxyethylcellulose (D.S. ~1) | 0.2 |
| BPP | 5.0 |
| Water, Buffering Agents, and Minors pH = 1 | up to 100 |

EXAMPLE V

Aqueous compositions containing anionic detergent surfactant (sodium coconut alkyl sulfate), nonionic detergent surfactant [$C_{9-11}$ alkyl polyethoxylate (6)], and zwitterionic detergent surfactant (Varion CAS Sulfobetaine), respectively at levels of 0.05, 0.5, and 8%, are prepared with the addition of about 0.11% xanthan gum and dispensed through the commercial trigger-type spray device used with the commercial product CINCH ®. All of the compositions are dispensed as visible foams.

EXAMPLE VI

Compositions with the following ranges of ingredients are exceptionally stable at temperatures of from about 40° F. to about 120° F. By balancing the hydrophobic and hydrophilic ingredients one can avoid separation of the xanthan gum at higher temperatures.

| | Weight % |
|---|---|
| Ingredient Range | |
| Zwitterionic Detergent | 1-3 |
| Nonionic Detergent | 1-3 |
| Hydrophobic Solvent | 5-7 |
| Citric Acid | 3-6 |
| Xanthan Gum | 0.1-0.15 |
| Sodium Cumene Sulfonate | 3-4 |
| Water, Buffering Agents, and Minors | up to 100 |
| pH = ~3 | |
| Specific Ingredient | |
| DDHPS | 2.0 |
| DPE6 | 2.0 |
| BPP | 6.0 |
| Citric Acid | 4.5 |
| Xanthan Gum | 0.11 |
| Sodium Cumene Sulfonate | 3.5 |
| Water, Buffering Agents, and Minors | up to 100 |
| pH = ~3 | |

This formula provides effective disinfectancy.

What is claimed is:

1. Article of manufacture comprising slightly thickened, shear-thinning, pseudoplastic liquid detergent composition having a viscosity in the range of from about 15 to about 250 cps, packaged in a non-aerosol spray device that produces a liquid spray for viscosities below about 15 cps, said composition being capable of being dispensed with a clearly visible content of foam from said device.

2. The article of manufacture of claim 1 wherein said of said spray device is a trigger-type spray device.

3. The article of manufacture of claim 2 wherein said composition comprises from about 0.01% to about 1% of polymeric shear-thinning thickener to raise said viscosity to from about 30 cps to about 100 cps.

4. The article of manufacture of claim 3 wherein said polymeric shear-thinning thickener is present at a level of from about 0.05% to about 0.5%.

5. The article of manufacture of claim 1 wherein said composition comprises from about 0.01% to about 1% of polymeric shear-thinning thickener to raise said viscosity from below 15 cps to above about 30 cps.

6. The article of manufacture of claim 5 wherein said polymeric shear-thinning thickener is present at a level of from about 0.05% to about 0.5%.

7. Slightly thickened, shear-thinning, pseudoplastic liquid detergent composition containing from about 0.1% to about 20% of detergent surfactant, and having a viscosity in the range of from about 30 to about 250 cps, which is an acidic aqueous hard surface detergent composition comprising: (a) mixture of zwitterionic and nonionic detergent surfactants; (b) hydrophobic solvent that provides a cleaning function; (c) polycarboxylate detergent builder; (d) from about 0.01% to about 1% of polymeric shear-thinning thickener to raise said viscosity from below 15 cps to above about 30 cps; and (e) the balance being an aqueous solvent system and minor ingredients, the pH of said composition being from about 1 to about 5.5 and said composition being capable of being dispensed as a foam from a non-aerosol, trigger-type, spray device that produces a liquid spray when the viscosity of the composition is below about 15 cps.

8. The composition of claim 7 wherein said zwitterionic detergent surfactant has the formula:

$$R—N(^+)(R^2)(R^3)R^4X(^-)$$

wherein R is a hydrophobic group; $R^2$ and $R^3$ are each $C_{1-4}$ alkyl, hydroxy alkyl or other substituted alkyl group which can also be joined to form ring structures with the N; $R^4$ is a moiety joining the cationic nitrogen atom to the hydrophilic group and is an alkylene, hydroxy alkylene, or polyalkoxy group containing from about 1 to about 4 carbon atoms; and X is the hydrophilic group which is a carboxylate or sulfonate group.

9. The composition of claim 8 containing sufficient buffering material to maintain a pH of about 2 to about 4.5.

10. The composition of claim 8 wherein said nonionic detergent surfactant has an HLB of from a to about 14.

11. The composition of claim 10 from about 1% to about 15% of said organic solvent (b), said solvent being selected from the group consisting of alkyl and cycloalkyl hydrocarbons and halohydrocarbons, alpha olefins, benzyl alcohol, glycol ethers, and diols containing 6 to 16 carbon atoms.

12. The composition of claim 11 said solvent (b) has the formula $R^1O(R^2O)_mH$ wherein each $R^1$ is an alkyl group which contains from about 4 to about 8 carbon atoms, each $R^2$ is selected from the group consisting of ethylene or propylene, and m is a number from 1 to about 3.

13. The composition of claim 11 wherein said solvent (b) is selected from the group consisting of dipropyleneglycolmonobutyl ether, monopropyleneglycolmonobutyl ether, diethyleneglycolmonohexyl ether, monoethyleneglycolmonohexyl ether, and mixtures thereof.

14. The composition of claim 8 wherein said zwitterionic detergent surfactant is a hydrocarbyl-amidoalkylenesulfobetaine having the formula:

$$R—C(O)—N(R^2)—(CR^3{}_2)_n—N(R^2)_2(^+)—(CR^3{}_2)_n—S(O)_3(^-)$$

wherein each R is an alkyl group containing from about 10 to about 18 carbon atoms, each ($R^2$) is selected from the group consisting of methyl, ethyl, propyl, hydroxy substituted ethyl or propyl and mixtures thereof, each ($R^3$) is selected from the group consisting of hydrogen and hydroxy groups, and each n is a number from 1 to about 4; with no more than about one hydroxy group in any ($CR^3{}_2$) moiety.

15. The composition of claim 14 wherein said nonionic detergent surfactant has an HLB of from about 10 to about 14.

16. The composition of claim 15 containing sufficient buffering material to maintain a pH of from about 2 to about 4.5.

17. The composition of claim 16 containing from about 1% to about 15% of said organic solvent (b), said solvent being selected from the group consisting of alkyl and cycloalkyl hydrocarbons and halohydrocarbons, alpha olefins, benzyl alcohol, glycol ethers, and diols containing 6 to 16 carbon atoms.

18. The composition of claim 17 from about 1% to about 15% of organic solvent (b) having the formula $R^1O(R^2O)_mH$ wherein each $R^1$ is an alkyl group which contains from about 4 to about 8 carbon atoms, each $R^2$ is selected from the group consisting of ethylene or propylene, and m is a number from 1 to about 3.

19. The composition of claim 8 wherein the level of said zwitterionic detergent surfactant is from about 0.01% to about 8%; the level of said nonionic detergent surfactant is from about 0.1% to about 6%; the ratio of said nonionic to said zwitterionic detergent surfactant is from about 1:4 to about 3:1; the level of said hydrophobic solvent is from about 1% to about 15%; the level of said polycarboxylate detergent builder is from about 2% to about 14% and the pH of said composition is from about 2 to about 4.5.

20. The composition of claim 19 wherein the level of said zwitterionic detergent surfactant is from about 1% to about 6%; the level of said nonionic detergent surfactant is from about 0.5% to about 6%; the ratio of said nonionic to said zwitterionic detergent surfactant is from about 1:3 to about 2:1; the level of said hydrophobic solvent is from about 2% to about 12%; the level of said polycarboxylate detergent builder is from about 3% to about 12%; and the pH of said composition is from about 2 to about 4.5.

21. Slightly thickened, stable, shear-thinning, pseudoplastic liquid detergent composition consisting essentially of: from about to about 3% of 3-(N-dodecyl-N,N-dimethyl)-2-hydroxypropane-1-sulfonate: from about 1% to about 3% decyl polyethoxylate (6): from about 5% to about 7% butoxy propoxy propanol; from about 3% to about 6% citric acid; from about 0.1% to about 0.15% xanthan gum; from about 3% to about 4% sodium cumene sulfonate; and the balance being water, buffering agents, and minor ingredients.

22. Article of manufacture comprising slightly thickened, shear-thinning, pseudoplastic liquid detergent composition which is an acidic aqueous hard surface detergent composition comprising: (a) mixture of zwitterionic and nonionic detergent surfactants; (b) hydrophobic solvent that provides a cleaning function; (c) polycarboxylate detergent builder; and (d) the balance being an aqueous solvent system and minor ingredients, the pH of said composition being from about 1 to about 5.5, said composition containing from about 0.1% to about 20% of detergent surfactant and from about 0.01% to about 1% of polymeric shear-thinning thickener to raise the viscosity from below 15 cps to above about 30 cps and below about 250 cps, said composition being capable of being dispensed as a foam from a non-aerosol, trigger-type, spray device that produces a liquid spray for viscosities below about 15 cps.

* * * * *